US005236299A

United States Patent [19]

Oskam

[11] Patent Number: 5,236,299

[45] Date of Patent: Aug. 17, 1993

[54] HITCHING DEVICE FOR INDUSTRIAL VEHICLE

[76] Inventor: John Oskam, R.R. #4, Guelph, Ontario, Canada, N1H 6J1

[21] Appl. No.: 846,505

[22] Filed: Mar. 6, 1992

[51] Int. Cl.[5] ..... B66F 9/12

[52] U.S. Cl. ..... 414/608

[58] Field of Search ..... 414/607, 608; 280/481, 280/495, 498

[56] References Cited

U.S. PATENT DOCUMENTS

| | | | |
|---|---|---|---|
| 2,699,878 | 1/1955 | Avery | 414/607 X |
| 2,772,918 | 12/1956 | Klinger | 414/607 X |
| 2,829,896 | 4/1958 | Swenson | 414/607 X |
| 3,101,128 | 8/1963 | Dane | 414/607 X |
| 3,207,085 | 9/1965 | Burr | 414/607 X |
| 3,583,061 | 6/1971 | Adams | 414/607 X |
| 3,791,544 | 2/1974 | Moses | 414/607 |
| 3,881,619 | 5/1975 | Morris | 414/607 |
| 4,061,237 | 12/1977 | Austin et al. | 414/608 X |
| 4,111,452 | 9/1978 | Carlsson | 414/608 X |
| 4,286,913 | 9/1981 | Rowe et al. | 414/608 X |
| 4,657,469 | 4/1987 | Beierle et al. | 414/608 X |
| 4,708,576 | 11/1987 | Conley | 414/607 |

*Primary Examiner*—David A. Bucci

[57] ABSTRACT

The hitching device of the present invention is adapted to connect an industrial vehicle to a load-carrying trailer to permit the vehicle to maneuver the load-carrying trailer. The industrial vehicle is of the type having a pair of forks which are substantially parallel to each other. The hitching device comprises a frame which is connectable to the load-carrying trailer by a connector. First and second bars are disposed on the frame remote from the connector. These bars lie substantially parallel to each other and substantially at right angles to the direction of travel of the forks of the vehicle. The bars are vertically and horizontally spaced from each other so that a gap is formed between them for receiving the forks. The second bar is disposed so that it lies vertically below the first bar, and so that it extends horizontally further from the connector than does the first bar when the forks are raised by the vehicle to a position which enables the vehicle to push or pull the load-carrying trailer. The configuration of the second bar substantially prevents the forks from being horizontally withdrawn from the hitching device until the forks are lowered by the vehicle. In this position, the industrial vehicle can pull the load-carrying trailer.

3 Claims, 2 Drawing Sheets

HITCHING DEVICE FOR INDUSTRIAL VEHICLE

BACKGROUND OF THE INVENTION

This invention relates generally to a hitching device and more specifically to a hitching device for industrial vehicles which allows the vehicles to engage and maneuver trailers and the like.

SUMMARY OF THE PRIOR ART

The device of the present invention is adapted for use with an industrial vehicle which includes a pair of forked projections which are substantially parallel to each other. A forklift is an example of the type of industrial vehicle referred to.

If large or cubersome loads such as steel pipes or large tanks are received at a warehouse, they would typically be maneuver around the warehouse in small quantities by either an overhead crane mechanism or a forklift. If a forklift is used, the steel pipes would be carried substantially parallel to the ground and perpendicular to the direction of travel of the forklift. This method of transportation requires a large amount of space in the warehouse for maneuvering of loads and often requires that the product be put down and then re-lifted by the forklift in order to get through narrower spaces such as doorways.

The above problems have been partially addressed in the prior art. In U.S. Pat. No. 3,258,146, granted Jun. 28, 1966, Hamilton discloses a power lift truck hitching device which is connectable to a trailer. The hitching device permits an industrial truck or forklift to move a trailer loaded with products. The hitching device comprises two spaced parallel sleeve members which are elongate and have open ends permitting the forks of the forklift to be received therein. If the load on the trailer is quite heavy and long, which would be the case with steel piping, it is easier to maneuver the trailer by pulling it than pushing it. If the device proposed by Hamilton is used in this manner, the forks of the forklift would simply pull out of the elongate sleeves. Hamilton discloses that it is necessary to secure the trailer to the industrial truck for this type of maneuver. An apertured stud is therefore provided on the front of the hitching device to receive one end of a connector which has its other end fixed to the forklift. While this mechanism prevents the forks from slipping out of the sleeves of the hitching device, it requires the operator to climb down from the forklift to secure the connector, to climb back up to drive the forklift, and then climb down again to release the trailer when the desired destination is reached.

In addition to this disadvantage, a driver of some skill would probably be needed to operate the forklift in order to guide the forks into the narrow parallel sleeves as disclosed by Hamilton. The forklift would have to approach the hitching device at the correct angle and height to allow the forks to enter the sleeves and to prevent them from causing damage to the sleeves and to the forks themselves.

SUMMARY OF THE INVENTION

It is an object of the present invention to overcome the disadvantages of the prior art.

It is therefore an object of the present invention to provide a hitching device which allows the forked extensions of an industrial vehicle to be easily inserted and withdrawn therefrom.

It is a further object of the invention to provide a hitching device which automatically locks the forks therein when the forks of the industrial vehicle are raised, thereby permitting the load-carrying means to be pulled by the industrial vehicle without the driver having to climb down from the vehicle to attach or detach the hitching device.

The hitching device of the present invention is adapted to be attached to a trailer or any other load-carrying means. The device is adapted to connect an industrial vehicle to the load-carrying means to permit the vehicle to maneuver the trailer.

The industrial vehicle is of the type having a pair of forks which are substantially parallel to each other. An example of such a vehicle is a forklift. The forks comprise horizontal members and vertical members which are connected to each other substantially at right angles so that a corner is formed between said members. The vertical members are secured to a vertically movable platform on the vehicle, the platform being adapted to raise and lower the forks with respect to the surface upon which the vehicle stands.

The hitching device comprises a frame which is connectable to the load-carrying means by a connection means. First and second bars are disposed on the frame remote from the connection means. These bars lie substantially parallel to each other and substantially at right angles to the direction of travel of the horizontal members of the vehicle. The bars are vertically and horizontally spaced from each other so that a gap is formed between them for receiving the horizontal members of the forks. The second bar is disposed so that it lies vertically below the first bar and extends horizontally further from the connection means than does the first bar when the forks are disposed in the frame so as to permit the vehicle to push or pull the load-carrying means.

When the vertical members of the forks engage the first bar, the vehicle is able to push the load-carrying means. When the corners of the forks engage the second bar, the vehicle is able to pull the load-carrying means.

The second bar is configured so that when the horizontal members are inserted into the gap and the forks are vertically raised by the forklift to a height at which the forks become substantially locked in place and prevented by the second bar from being horizontally withdrawn from the gap until the forks are lowered again, the vehicle can pull the load-carrying means. In the preferred embodiment of the invention, the second bar is substantially L-shaped.

BRIEF DESCRIPTION OF THE DRAWINGS

The preferred embodiment of the invention will now be described with the aid of the following drawings, in which.

DETAILED DESCRIPTION OF THE PREFERRED EMBODIMENT

Figure 1:
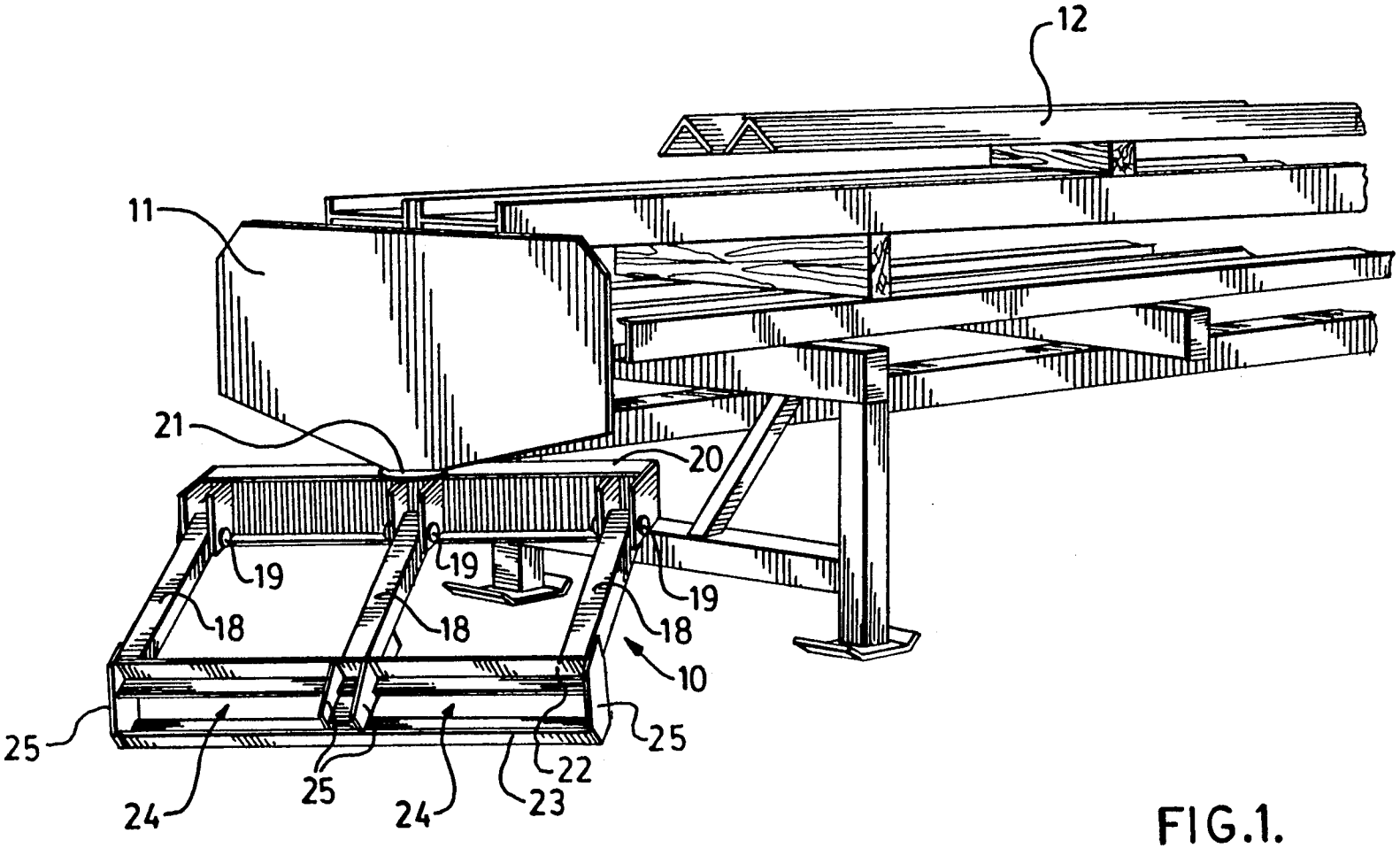
FIG. 1 is a perspective view of a hitching device in accordance with the present invention.

The device of the present invention is described with respect to forklifts, but may be used with any industrial vehicle of the type which includes a pair of forks which are substantially parallel to each other.

The hitching device of the present invention comprises a frame 10 which may be attached to a trailer 11, or any other load-carrying means, by a suitable mechanism. The trailer 11 is adapted to carry loads 12. A forklift 13 is used to either push or pull the trailer 11 by being connected thereto by the hitching device of the present invention.

The forklift 13 has forks which comprise horizontal members 14 which engage the hitching device, and vertical members 15 which are secured to a vertically movable platform 16 on the forklift 13. The platform 16 raises and lowers the forks with respect to the surface S upon which the forklift 13 stands. The horizontal members 14 are connected to the vertical members 15 substantially at right angles, so that a corner 17 is formed between them.

The frame 10 of the hitching device comprises a plurality of limbs 18 which are each pivotally connected at pivot points 19 to a strut 20. The limbs 18 are mounted substantially at right angles to the strut 20 and are adapted to pivot vertically. The strut 20 is connected by any suitable connection means 21 to the trailer. In the preferred embodiment of the invention, the strut 20 is horizontally pivotally connected to the trailer 11 to increase the maneuverability of the trailer 11.

Figure 3:
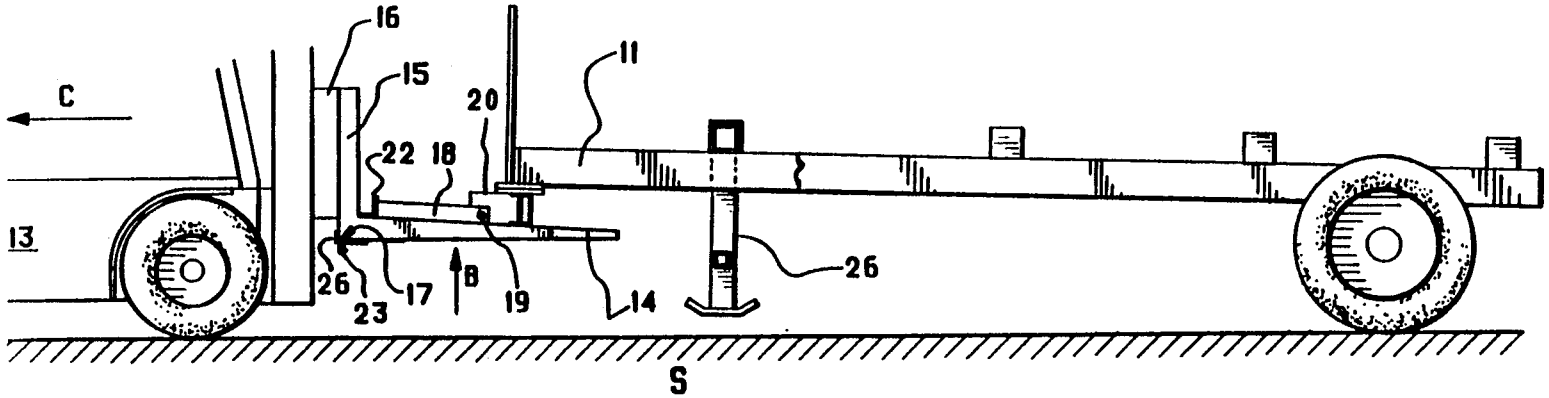
FIG. 3 is a side view of the hitching device showing the bars locking the forks of the forklift in place.

First and second bars 22,23 are disposed on the frame 10 substantially parallel to each other, and to the strut 20, and are disposed substantially at right angles to the direction of travel of the horizontal members 14 of the forklift 13. The first and second bars 22,23 are also disposed substantially at right angles to the limbs 18, and are remote from the connection point 21 of the strut 20 to the trailer 11. The first and second bars 22,23 are vertically and horizontally spaced from each other so that a gap 24 is formed between them for receiving the horizontal members 14. The second bar 23 is so disposed that it lies vertically below the first bar 22 and extends horizontally further from the strut 20 than does the first bar 22 when the forks are locked into the hitching device as is shown in FIG. 3.

The first and second bars are fixedly connected to each other by plates 25, which plates 25 lie substantially at right angles to said first and second bars. The first bar 22 is connected to the limbs 18.

Figure 2:
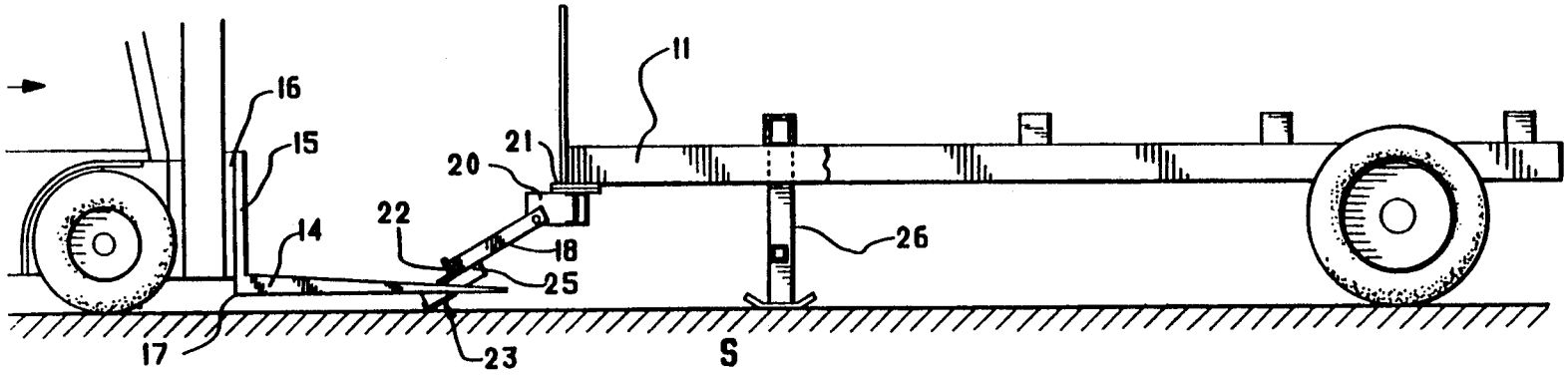
FIG. 2 is a partially cut-away side view of the hitching device of FIG. 1, showing the shape and angle of the bars.

As can best be seen from FIG. 2, the second bar 23 is substantially L-shaped and is disposed on the frame 10 so that the L-shape opens towards the strut 20. The first bar 22 may also be substantially L-shaped.

The hitching device is used in the following manner:

A forklift 13 is driven towards the frame 10 of the hitching device in the direction of arrow A in FIG. 2. The horizontal members 14 of the forks are inserted into the gap 24 between the first and second bars 22,23 to the point that the corners 17 contact the inside angle of the L-shaped second bar 23. The platform 16 is actuated to raise the horizontal members 14 in the direction of arrow B in FIG. 3. It is not necessary to insert the horizontal member 14 to the point that the corners 17 contact the second bar 23 before the forks are raised. The raising and insertion of the forks can occur substantially simultaneously. The horizontal members 14 engage the first bar 22 causing the limbs 18 to pivot upwardly about the pivot points 19, in the direction of arrow B. When the forks are raised to a sufficient height, the corners 17 engage in the inside angle of the second bar 23 and the forks thereby become locked in the hitching device. In this position they are substantially prevented from being horizontally withdrawn from the gap 24 in the direction of arrow C in FIG. 3.

If the trailer has a footing 26, the platform 16 is moved upwardly until the forks cause the footing 26 to be lifted off the surfaces S (FIG. 3). The forklift 13 can the maneuver the trailer 11 and load 12 around the warehouse. Alternatively, if the trailer 11 has a wheel in place of the footing 26, once the forks are locked into the hitching device, the trailer can be pulled around the warehouse. The first bar 22 acts to stabilize the movement of the trailer 11 when it is being pulled by the forklift 13.

When the desired destination is reached, the platform 16 lowers the horizontal members 14. This causes the limb 18 to pivot downwardly towards the surface S, breaking the contact between the corners 17 and the inside angle of the second bar 23. The horizontal members 14 are released for movement from between the first and second bars 22,23 and they may then be withdrawn from the gap 24.

The trailer 11 may also be pushed by the forklift 13. In this instance, the horizontal members 14 are inserted into the gap 24 and raised by the platform to a height sufficient to permit the vertical members 15 to engage the first bar 22. In this position the forklift 13 may be driven forward in the direction of arrow A in FIG. 2, causing the trailer 11 to be pushed in the direction of arrow A. If the trailer 11 has a footing 26, the forks must be raised off the surface S sufficiently to cause the footing 26 to be lifted off the surface.

Because the pulling locking mechanism is actuated by the raising of the horizontal members 14 from the surface S, and is deactivated by lowering the horizontal members 14 towards the surface S, there is no need for the operator to climb down from the forklift 13 to secure or release the hitching device. The configuration of the gap 24 also permits the driver of the forklift 13 to approach the hitching device from generally the correct direction and engagement with the hitching device is relatively easily achievable.

While the invention has been described in conjunction with specific embodiments thereof, it is evident that many alternatives, modifications, and variations will be apparent to those skilled in the art in the light of the foregoing description. Accordingly, it is intended to embrace all such alternatives, modifications and variations, as fall within the spirit and broad scope of the appended claims.

The embodiments o the invention in which an exclusive property or privilege is claimed are defined as follows:

1. A hitching device for connecting an industrial vehicle to a means for carrying a load, said industrial vehicle being of the type having a pair of forks substantially parallel to each other, said forks comprising vertical members connected to said forks substantially at right angles, said device comprising:

a strut having a connection means for connecting said device to a load carrying means, a plurality of limbs, each of said limbs having a pivoting end pivotally connected to said strut substantially at right angles thereto, a first bar fixedly connected at substantially right angles to said plurality of limbs at an end region opposite said pivoting end, and a second bar fixedly connected to said first bar in an offset spaced parallel relation presenting a gap therebetween adapted for receiving said forks, whereby as said forks are raised to support said load-carrying means, said limbs pivot for abutting said first bar and second bar against said vertical members from opposite sides thereof permitting said vehicle to push and pull the means for carrying a load.

2. A hitching device as defined in claim 1, wherein said first bar is connected to said second bar by plates disposed at substantially at right angles thereto.

3. A hitching device as defined in claim 1, wherein the strut is horizontally pivotally connectable to the load-carrying means.

* * * * *